United States Patent [19]

Martin et al.

[11] Patent Number: 4,798,633

[45] Date of Patent: Jan. 17, 1989

[54] NICKEL-BASE ALLOY HEAT TREATMENT

[75] Inventors: James M. Martin, Proctorville, Ohio; James R. Crum, Ona, W. Va.; William L. Mankins; Jeffrey M. Sarver, both of Huntington, W. Va.

[73] Assignee: INCO Alloys International, Inc., Huntington, W. Va.

[21] Appl. No.: 911,474

[22] Filed: Sep. 25, 1986

[51] Int. Cl.[4] ..... C22F 1/10

[52] U.S. Cl. ..... 148/162; 148/410

[58] Field of Search ..... 148/162, 13, 410, 427, 148/428; 420/445, 446, 451, 452

[56] References Cited

U.S. PATENT DOCUMENTS 3,573,901 6/1971 Economy ..... 420/446

3,574,604 4/1971 Copson et al. ..... 420/446

OTHER PUBLICATIONS

"A Stress Corrosion Cracking Evaluation of Inconel 690 for Steam Generator Tubing Applications", G. P. Airey, A. R. Vala and R. G. Aspden, pp. 436–448, published Mar. 24, 1981.

*Primary Examiner*—R. Dean

*Attorney, Agent, or Firm*—Raymond J. Kenny; Francis J. Mulligan, Jr.

[57] ABSTRACT

A process for heat treating certain nickel-chromium-iron alloys is disclosed which involves annealing the alloys over the temperature range of 1750° F. to 2150° F., preferably in a continuous annealing furnace, for short periods of time, such as 30 minutes to 2 hours, the time being sufficient to precipitate carbides at the alloy grain boundaries. The alloys are useful in nuclear reactor environments.

10 Claims, 1 Drawing Sheet

NICKEL-BASE ALLOY HEAT TREATMENT

The present invention is concerned with heat treating certain nickel alloys, and is particularly directed to a novel heat treatment for nickel-base alloys of relatively high chromium content designed for critical applications, including the production of tubing for use in nuclear reactors.

INVENTION BACKGROUND

In the late 1950's French researchers opined that tubing produced from an alloy known as Alloy 600 (nominally 72% Ni minimum, 14–17% Cr and 6–10% Fe) was susceptible to stress-corrosion attack in high purity water used in nuclear reactors. Until that time it was generally thought that the material was relatively immune to such an environment, at least in comparison with other available alloys. While there were those who considered that reactor design may have been causative of such failure, there is at least now a consensus that Alloy 600 will undergo stress-corrosion cracking with the passage of time. This in turn requires tube replacement which necessitates downtime and thus added cost.

Since circa 1960, we are aware of but one newly developed commercial alloy that has manifested an enhanced capability versus Alloy 600 to resist stress-corrosion cracking (SCC) in reactor environments, an alloy sold commercially as Alloy 690 (nominally 27–31% Cr, 7–11% Fe, 0.04% C max, balance Ni and incidental elements). Alloy 690 has gained increasing acceptance and is currently being specified as a replacement for 600 tubing. However, common to both alloys is that they are given a long time carbide precipitation heat treatment, 10–15 hours, subsequent to a mill annealing treatment. The reason for this in Alloy 600 stems from the concept of producing intergranular carbides and replenishing the area adjacent to the carbides with chromium so as to prevent sensitization caused by chromium depleted grain boundaries. As a consequence, the grain boundaries are rendered greatly less susceptible to SCC while showing no signs of sensitization.

By way of further explanation, the inner surface of tubing in respect of nuclear reactors of the high purity primary pressurized water (PWR) type is exposed to the SCC effect of the water whereas the outer surface is exposed to secondary water which may possibly contain deaerated caustic solution. The conventional 10–15 hour treatment mentioned supra provides the desired intergranular carbide precipitates thereby preventing or greatly minimizing intergranular stress-corrosion cracking of Alloy 600 in water, while cracking of Alloy 690 in water is naturally prevented by its high chromium content. This treatment also enhances both alloys' ability to resist the SCC propensity caused by the caustic solution, the effectiveness thereof being dependent upon carbon content and the mill anneal.

But long term heat treatments preclude the use of continuous annealing furnaces. Indeed as presently understood and speaking from a commercial viewpoint, there are but three current nuclear tubing manufacturers who have the necessary furnace equipment and capability to cope/deal with such long term heat treatments in the manufacture of Alloy 690 tubing. And none today is operating in the United States. Thus, the result is higher tubing costs as well as, competitively speaking, a trade disadvantage. Accordingly, the problem is one of markedly reducing the length of thermal treatment such that continuous annealing furnaces can be employed in the final sequence of operations utilized in the production of such tubing.

Given the foregoing, the problem is recognized in U.S. Pat. No. 4,336,079 anent Alloy 600. The solution described there, however, would only improve the sensitization resistance of Alloy 600 without imparting increased resistance to SCC. This is due to the formation of intragranular carbides instead of intergranular carbides. The latter are formed during the long time heat treatment and have been shown to be effective in the prevention of caustic SCC. Intragranular carbides do not afford such a benefit. It might be added that the heat treatment described in '079 would not be applicable to Alloy 690 which is not susceptible to sensitization due to its high chromium content.

SUMMARY OF THE INVENTION

It has now been discovered that Alloy 690 tubing (i) does not require a lengthy thermal treatment to prevent sensitization, (ii) can be given a short term heat treatment, e.g., less than one hour, (iii) and its stress-corrosion cracking resistance is not adversely affected, (iv) whereby a continuous annealing furnace can be used (v) with significantly greater efficiency and lower processing costs. Moreover, the short term thermal treatment described herein results in enhanced resistance to caustic stress-corrosion cracking in comparison with Alloy 600 conventionally treated and is deemed at least comparable to Alloy 690 conventionally treated.

DESCRIPTION OF DRAWING

The accompanying drawing depicts a carbon solubility curve correlating temperature and carbon content.

INVENTION EMBODIMENTS

Figure 1:
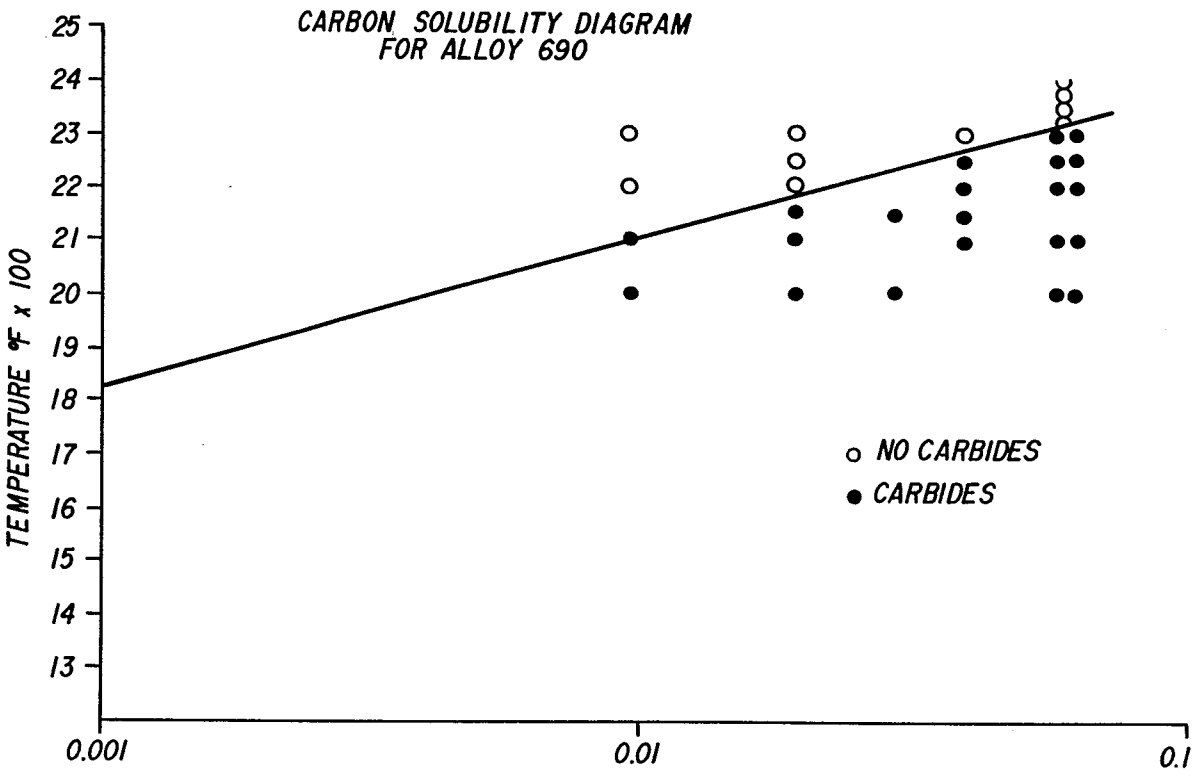

Generally speaking and accordance herewith, the present invention contemplates subjecting subsequent to a mill annealing treatment, Alloy 690 tubing to a thermal heat treatment over the range of about 1200° to 1700° F. (about 649°–927° C.) for a period well less than 5 hours, particularly less than 1 hour.

In carrying the invention into practice the mill annealing heat treatment, i.e., the heat treatment applied before the thermal treatment, should be conducted at a temperature and for a period of time sufficient to soften the alloy tubing and to cause substantial recrystallization. Normally, in producing the tubing cold working is employed as by tube drawing and tube reducing. Thus, a mill anneal is required. It is preferred that this treatment be conducted within the range of 1750° to 2150° F. (954°–1177° C.) for up to about 1 hour, the longer times being used with the lower temperature. A satisfactory range is 1850° to 2000° F. (1010°–1093° C.) for up to 30 minutes, e.g., 15 minutes at 1900° F. (1038° C.).

The thermal heat treatment need not be conducted for longer than 30 minutes, in marked contrast to the conventional 10–15 hours treatment currently used, though longer periods, say up to 2 hours, can be employed if desired. However, there is no practical necessity to use a period of time over one hour. A preferred temperature range is from 1300° F. (704° C.) to 1600° F. (871° C.), the higher temperatures being used with the lower time periods. A temperature down to 1200° F. (649° C.) and up to 1700° F. (927° C.) might be used but is deemed that there would be no significant advantage in so doing. Of importance, given the ability to use such a short period of heat treatment, and at the risk of over emphasis, continuous annealing furnaces can be utilized as indicated above herein, at a considerable cost advantage.

That a drastically short thermal heat treatment could be used for Alloy 690 was due, at least in part, to the finding or determination that the higher chromium content of 690 resulted in rather different carbon solubility characteristics and carbide precipitation reactions that for Alloy 600. This suggested that possibly an optimum heat treatment for SCC resistance might also be different. In this connection a carbon solubility curve, FIG. 1, was determined for 690 starting with a virtually carbon free material up to a 0.06% carbon level, the chemistries being reported in Table I below.

TABLE I

Chemical Composition of Test Materials (In Weight Percent)

| Alloy | C | Mn | Fe | S | Si | Cu | Ni | Cr |
|---|---|---|---|---|---|---|---|---|
| 1 | 0.001 | 0.02 | 9.2 | 0.001 | 0.001 | 0.03 | Bal | 28.7 |
| 2 | 0.01 | 0.06 | 9.8 | 0.003 | 0.06 | 0.02 | Bal | 28.8 |
| 3 | 0.016 | 0.19 | 8.8 | 0.002 | 0.10 | 0.26 | Bal | 27.9 |
| 4 | 0.02 | 0.03 | 9.6 | 0.003 | 0.05 | 0.01 | Bal | 29.9 |
| 5 | 0.02 | 0.02 | 9.3 | 0.001 | 0.001 | 0.03 | Bal | 28.7 |
| 6 | 0.021 | 0.21 | 9.5 | 0.001 | 0.39 | 0.28 | Bal | 29.9 |
| 7 | 0.039 | 0.15 | 9.4 | 0.008 | 0.15 | 0.30 | Bal | 29.8 |
| 8 | 0.04 | 0.02 | 9.1 | 0.002 | 0.001 | 0.02 | Bal | 29.0 |
| 9 | 0.06 | 0.01 | 9.8 | 0.003 | 0.05 | 0.02 | Bal | 29.5 |

The curve in FIG. 1 was based on a visual assessment at 500× using a light microscope for the presence or absence of carbides. Also used, was an etch which has been specified for Alloy 690 consisting of electrolytically etching metallographic specimens with an 80 parts $H_3PO_4$ – 10 parts $H_2O$ solution at about 0.2 amps for 15 seconds. Specimens were heat treated by (a) solution annealing at 2250° F. (1232° C.) for 3 hours, water quenching and reheating to the precipitation temperature set forth in FIG. 1 for periods of 1 minute to 100 hours and then again water quenching; or (b) solution annealing at 2350° F. (1288° C.) for 1 hour and then rapidly transferring the specimens to an adjacent furnace already at carbide precipitation temperature, the specimens being held at temperature for 1 hour and then rapidly water quenched. The line in FIG. 1 was drawn to exclude, as well as possible, those specimens with no visible carbides.

While determining the presence or absence of carbides visually is probably somewhat subjective, and (ii) while prior thermo-mechanical processing and (iii) long heat treatments with rapid quenching may possibly minimize observed effects, nonetheless the data and solubility curve depicted in FIG. 1 are deemed sufficiently reliable to postulate that the high chromium of Alloy 690 (a) markedly lowers solubility for carbon, (b) increases the speed of carbide precipitation and (c) greatly resists sensitization by reason of their being enough chromium remaining about the carbide particles to inhibit sensitization, i.e., there is self-replenishment of chromium to obviate chromium depleted grain boundaries.

To illustrate that a short term thermal heat treatment not only does not subvert the ability of 690 to resist SCC but enhances this characteristic reference is made to Tables II and III. Alloys 10 (0.01%C) and 11 (0.03%C) were given two different mill anneal treatments, 1900° F. (1038° C.)/20 minutes and 2000° F. (1093° C.)/20 minutes and were then subjected to a number of different thermal treatments ranging from 15 hours at 1300° F. (704° C.), i.e., a conventional treatment, to 10 minutes at 1600° F. (871° C.) as delineated in Table III. Alloy 12 (15.11% Cr) is a typical Alloy 600 composition and was included for purposes of comparison.

TABLE II

| Alloy | C | Mn | Fe | S | Si | Cu | Ni | Cr | Al | Ti |
|---|---|---|---|---|---|---|---|---|---|---|
| 10 | 0.01 | 0.21 | 10.22 | 0.001 | 0.25 | 0.26 | Bal | 29.25 | 0.15 | 0.28 |
| 11 | 0.03 | 0.18 | 9.49 | 0.001 | 0.21 | 0.24 | Bal | 29.92 | 0.21 | 0.27 |
| 12 | 0.03 | 0.35 | 7.60 | 0.007 | 0.21 | 0.29 | Bal | 15.11 | 0.50 | 0.26 |

TABLE III

Carbide Precipitation Heat Treatments For Alloy 690
Environment: Deaerated 10% NaOH, 662° F. (350° C.)
Samples: U-bends, Test Duration: 4,152 Hours

| Alloy | % C | Anneal °F. (°C.)/Hours | Reheat °F. (°C.)/Hours | Hours to Crack | Hours to Fail |
|---|---|---|---|---|---|
| 10 | .01 | 1900 (1038)/.33 | None | 1440 | 3120 |
| 10 | .01 | 1900 (1038)/.33 | None | 1440 | 3120 |
| 10 | .01 | 1900 (1038)/.33 | None | 1440 | 1440 |
| 10 | .01 | 1900 (1038)/.33 | 1300 (704)/1 | * | ** |
| 10 | .01 | 1900 (1038)/.33 | 1300 (704)/5 | * | ** |
| 10 | .01 | 1900 (1038)/.33 | 1300 (704)/15 | * | ** |
| 10 | .01 | 1900 (1038)/.33 | 1400 (760)/1 | * | ** |
| 10 | .01 | 1900 (1038)/.33 | 1500 (186)/.17 | * | ** |
| 10 | .01 | 1900 (1038)/.33 | 1600 (871)/.17 | * | ** |
| 10 | .01 | 2000 (1093)/.33 | 1400 (760)/1 | * | ** |
| 10 | .01 | 1900 (1038)/.33 | 1125 (607)/8 | * | ** |
| 10 | .01 | 1900 (1038)/.33 | 1125 (607)/8 | 3120 | ** |
| 11 | .03 | 2000 (1093)/.33 | None | 1440 | 4152 |
| 11 | .03 | 2000 (1093)/.33 | None | 1440 | 3120 |
| 11 | .03 | 2000 (1093)/.33 | 1300 (704)/1 | * | ** |
| 11 | .03 | 2000 (1093)/.33 | 1400 (760)/1 | * | ** |
| 12 | .03 | Mill Anneal | None | 720 | 720 |
| 12 | .03 | Mill Anneal | None | 720 | 720 |
| 12 | .03 | Mill Anneal | 1300 (704)/15 | 3120 | ** |
| 12 | .03 | Mill Anneal | 1300 (704)/15 | 3210 | ** |

*No cracking
**No Failure observed after 4152 hours

A cursory review of Table III reflects that the Alloy 690, as well as Alloy 600, U-bends were quite susceptible to stress-corrosion cracking in the test environment, deaerated 10% NaOH, at 662° F. (350° C.), in the mill annealed condition. What is of significance is that stress-corrosion cracking behavior of 690 for the short term thermal treatment e.g., 10 minutes to an hour, was as good as a conventional 15 hour treatment for 690 and quite superior to the 15 hour treatment for 600. Testing is continuing.

The foregoing discussion has centered upon alloy 690 and nuclear reactors. However, the alloy as heat treated in accordance herewith can be used in other applications, including other power plant applications containing similar environments or other applications where a deaerated caustic environment is encountered. In addition to tubing the alloy can be produced in various mill forms, including rod, bar, wire, pipe, plate, sheet and strip.

In terms of composition, the alloy contemplated herein for most applications can contain about 25 to 35% chromium, 5 to 15% iron, up to 0.1% carbon, up to 2% silicon, up to 2% manganese, up to 5% aluminum, up to 5% titanium, and the balance essentially nickel. For tubing intended for nuclear reactors the alloy should contain 28 to 32% chromium, 6 to 13% iron, up to 0.05% or 0.06% carbon, up to 0.5% each of silicon, manganese, and copper, balance essentially nickel. Sulfur and phosphorous should be held to as low a percentage as possible.

Although the present invention has been described in conjunction with preferred embodiments, it is to be understood that modifications and variations may be resorted to without departing from the spirit and scope of the invention, as those skilled in the art will readily understand. As will be understood by those skilled in the art, the thermal treatment disclosed herein is not limited to nuclear applications. Such modifications and variations are considered to be within the purview and scope of the invention appended claims.

We claim:

1. A process of heat treating nickel-base tubing characterized by good resistance to stress-corrosion cracking in high purity water nuclear reactor environments, including deaerated caustic solutions such as can be found in PWR secondary water environments, notwithstanding that it is given only a short duration thermal heat treatment, which comprises subjecting tubing formed from an alloy consisting essentially of about 28 to 32% chromium, about 6 to 13% iron, up to 0.06% carbon, up to about 0.5% each of silicon, manganese and copper and the balance essentially nickel, to treatment in a continuous annealing furnace within the temperature range of about 1750° to 2150° F. for about ¼ to 1 hour, and thereafter subjecting the tubing to a thermal treatment over the range of about 1300° to 1700° F. for a period of time at least sufficient to precipitate carbides at the grain boundaries, the period not exceeding about 2 hours.

2. The process set forth in claim 1 in which the annealing treatment is conducted over the temperature range of 1850° to 1950° F. for about ¼ hour to ½ hour.

3. The process set forth in claim 1 in which the thermal treatment is conducted within the temperature range of 1300° to 1400° F. for a period not exceeding about ½ hour.

4. As a new article of manufacture, tubing intended for nuclear reactors and heat treated in accordance with claim 1.

5. A process for heat treating nickel-base alloy mill products formed from an alloy consisting of about 25 to 35% chromium, 5 to 15% iron, up to 0.1% carbon, up to 2% each of the silicon and manganese, up to 5% each of aluminum and titanium, and the balance essentially nickel, which comprises subjecting the alloy to an annealing treatment in a continuous annealing furnace of from 1750° to 2150° F. for a period of sufficient to soften the mill product and to cause substantial recrystallization and thereafter subjecting the alloy to a thermal treatment of 1300° to 1700° F. for a period of time at least sufficient to form carbides at the grain boundaries and up to less than 5 hours.

6. The process set forth in claim 5 in which the annealing treatment is conducted within the temperature range of 1850° to 2000° F. for not more than about 1 hour to ½ hour and the thermal treatment is conducted over the temperature range of 1300° to 1600° F. for a period not exceeding 2 hours.

7. As a new article of manufacture, a mill product heat treated as set forth in claim 5 and which is seamless tubing.

8. The process as set forth in claim 1, in which the thermal treatment is conducted for a period of about 10 minutes to about 2 hours.

9. The process as set forth in claim 5 in which the thermal heat treatment is conducted for a period of about 10 minutes to about 2 hours.

10. A process for heat treating nickel-base alloy mill products formed from an alloy consisting of about 25 to 35% chromium, 5 to 15% iron, up to 0.1% carbon, up to 2% each of the silicon and manganese, up to 5% each of aluminum and titanium, and the balance essentially nickel, which comprises subjecting the alloy to an annealing treatment of from 1750° to 2150° F. for a period sufficient to soften the mill product and to cause substantial recrystallization, and thereafter subjecting the alloy to a thermal treatment of 1300° to 17000° F. for a period of time at least sufficient to form carbides at the grain boundaries and up to less than 1 hour.

* * * * *